US008464442B1

(12) United States Patent
Alford, II

(10) Patent No.: US 8,464,442 B1
(45) Date of Patent: Jun. 18, 2013

(54) SHOE DEVICE WITH ELECTRONIC GRAPHIC DESIGNS

(76) Inventor: James A. Alford, II, Mesa, AZ (US)

( * ) Notice: Subject to any disclaimer, the term of this patent is extended or adjusted under 35 U.S.C. 154(b) by 419 days.

(21) Appl. No.: 12/788,662

(22) Filed: May 27, 2010

(51) Int. Cl.
*A43B 23/00* (2006.01)

(52) U.S. Cl.
USPC ..... 36/137; 36/136; 362/103

(58) Field of Classification Search
USPC ..... 36/137, 136, 1
See application file for complete search history.

(56) References Cited

U.S. PATENT DOCUMENTS

| | | | | |
|---|---|---|---|---|
| 2,747,303 | A * | 5/1956 | Abrahams | 36/72 R |
| 4,709,307 | A | 11/1987 | Branom | |
| 5,577,828 | A | 11/1996 | Nadel et al. | |
| D388,940 | S | 1/1998 | Barker | |
| 5,722,192 | A | 3/1998 | Salley | |
| 5,813,148 | A | 9/1998 | Guerra | |
| 5,912,653 | A | 6/1999 | Fitch | |
| 6,030,089 | A * | 2/2000 | Parker et al. | 36/137 |
| 6,393,745 | B1 | 5/2002 | Miki | |
| 2009/0237912 | A1 * | 9/2009 | Tsai et al. | 362/84 |
| 2009/0288317 | A1 * | 11/2009 | Forbes | 36/136 |
| 2010/0223816 | A1 * | 9/2010 | Barfield | 36/136 |
| 2010/0289971 | A1 * | 11/2010 | Odland et al. | 348/801 |

* cited by examiner

*Primary Examiner* — Ted Kavanaugh

(57) ABSTRACT

A shoe device comprising a shoe component; at least one electronic display disposed on a portion of the shoe component, the electronic display is constructed from at least three layers including a center layer constructed from a flexible organic light-emitting diode (OLED) display for providing active color and graphics, a waterproof outer layer, and a fabric inner layer, the outer layer and inner layer sandwich the center layer; a universal serial bus (USB) port; a microprocessor operatively connected to the flexible OLED display and USB port, the microprocessor is configured to send output commands to the flexible OLED display to cause the flexible OLED display to display graphic data; and one or more control buttons for manipulating the microprocessor and flexible OLED display.

5 Claims, 4 Drawing Sheets

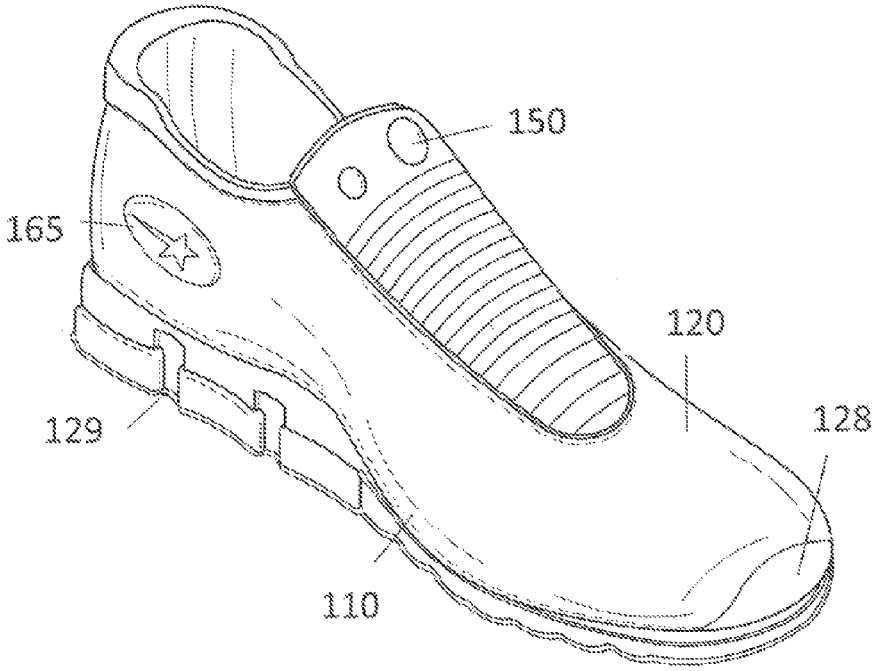
FIG. 1
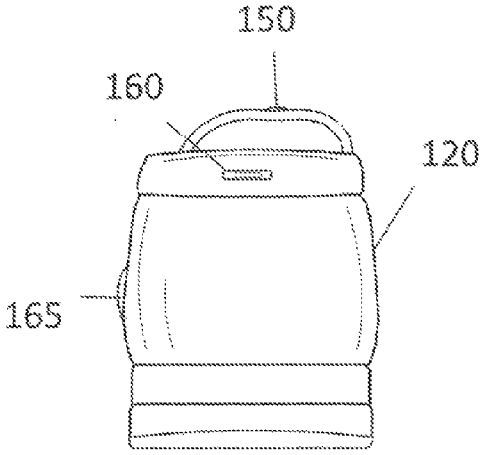
FIG. 2
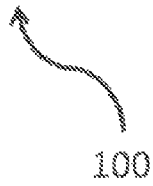

SHOE DEVICE WITH ELECTRONIC GRAPHIC DESIGNS

FIELD OF THE INVENTION

The present invention is directed to shoes, more particularly to shoes with electronic graphic designs, which provide enhanced style and appearance.

BACKGROUND OF THE INVENTION

Footwear is often standard and while shoes differ in shapes and styles, they lack graphic and electronic technology. The present invention features a shoe device with electronic graphic designs for enhancing the appearance of the shoe. The shoe has various displays, for example liquid crystal displays that display graphic patterns, colors, and designs. The shoe allows a user to download different colors and designs from a media, for example the Internet or a hard drive (memory storage media). A user can change his or her shoe style (e.g., appearance) when desired, and in some cases he/she can change styles (e.g., appearance) by pushing one or more buttons on the shoes. In some embodiments, logos and themes can be chosen, for example sports logos, holiday themes, etc.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a shoe device comprising a shoe component; at least one electronic display disposed on a portion of the shoe component, the electronic display is constructed from at least three layers including a center layer constructed from a flexible organic light-emitting diode (OLED) display for providing active color and graphics, a waterproof outer layer, and a fabric inner layer, the outer layer and inner layer sandwich the center layer; a universal serial bus (USB) port disposed in a heel area of the shoe component; a microprocessor disposed in the shoe component operatively connected to both the flexible OLED display and the USB port, the microprocessor comprises a memory component for storing graphic data, the microprocessor is configured to send output commands to the flexible OLED display to cause the flexible OLED display to display the graphic data, wherein the USB port functions to transfer alternate graphic data from a source to the memory component of the microprocessor; one or more control buttons disposed on the shoe component and operatively connected to the microprocessor, the microprocessor is configured to receive input signals from the control buttons and subsequently send output commands to the flexible OLED display to manipulate the flexible OLED display; and a power source operatively connected to microprocessor and the flexible OLED display.

In some embodiments, the shoe device further comprises air holes disposed in a sole area of the shoe component. In some embodiments, an electronic display is disposed on a top portion of the shoe component, a first side of the shoe component, a second side of the shoe component, or the heel area of the shoe component. In some embodiments; the inner layer comprises a moisture barrier to protect the flexible OLED display. In some embodiments, the shoe device further comprises a logo component disposed on the shoe component. In some embodiments, the source is an Internet website, a DVD, a CD, a memory device, a cellular phone, a smart phone, a personal digital assistant (PDA), or a digital vending kiosk. In some embodiments, the power source is a battery.

BRIEF DESCRIPTION OF THE DRAWINGS

FIG. 1 is a perspective view of the shoe device of the present invention.

FIG. 2 is a rear view of the shoe device of FIG. 1.

DESCRIPTION OF PREFERRED EMBODIMENTS

Figure 3:
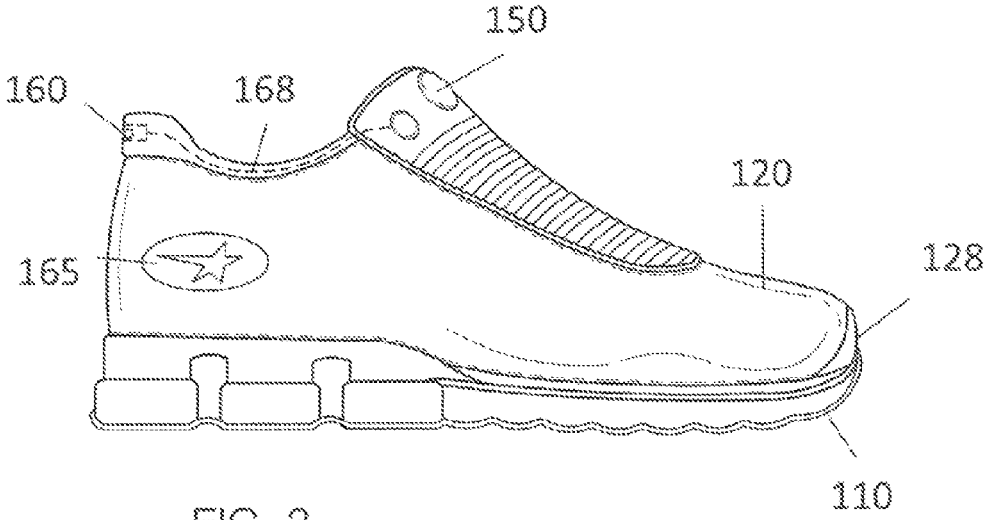
FIG. 3 is a side view of the shoe device of FIG. 1.
Figure 4:
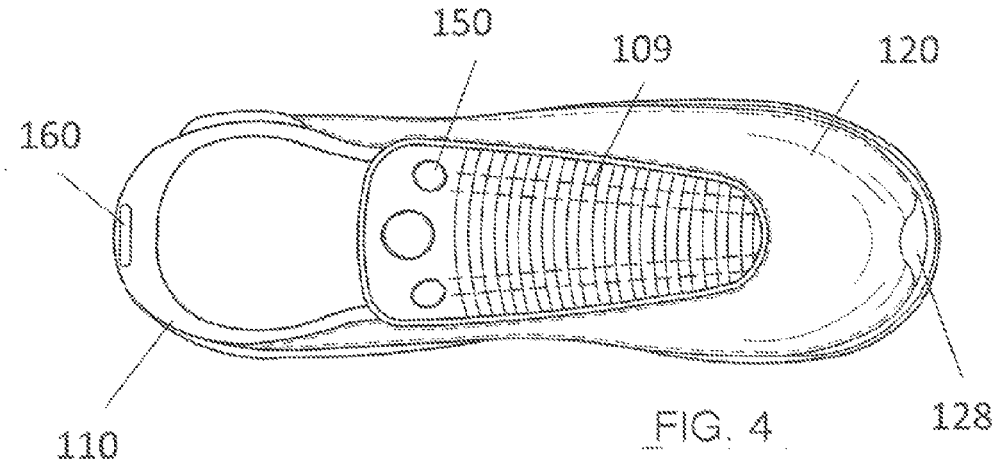
FIG. 4 is a top view of the shoe device of FIG. 1.
Figure 5:
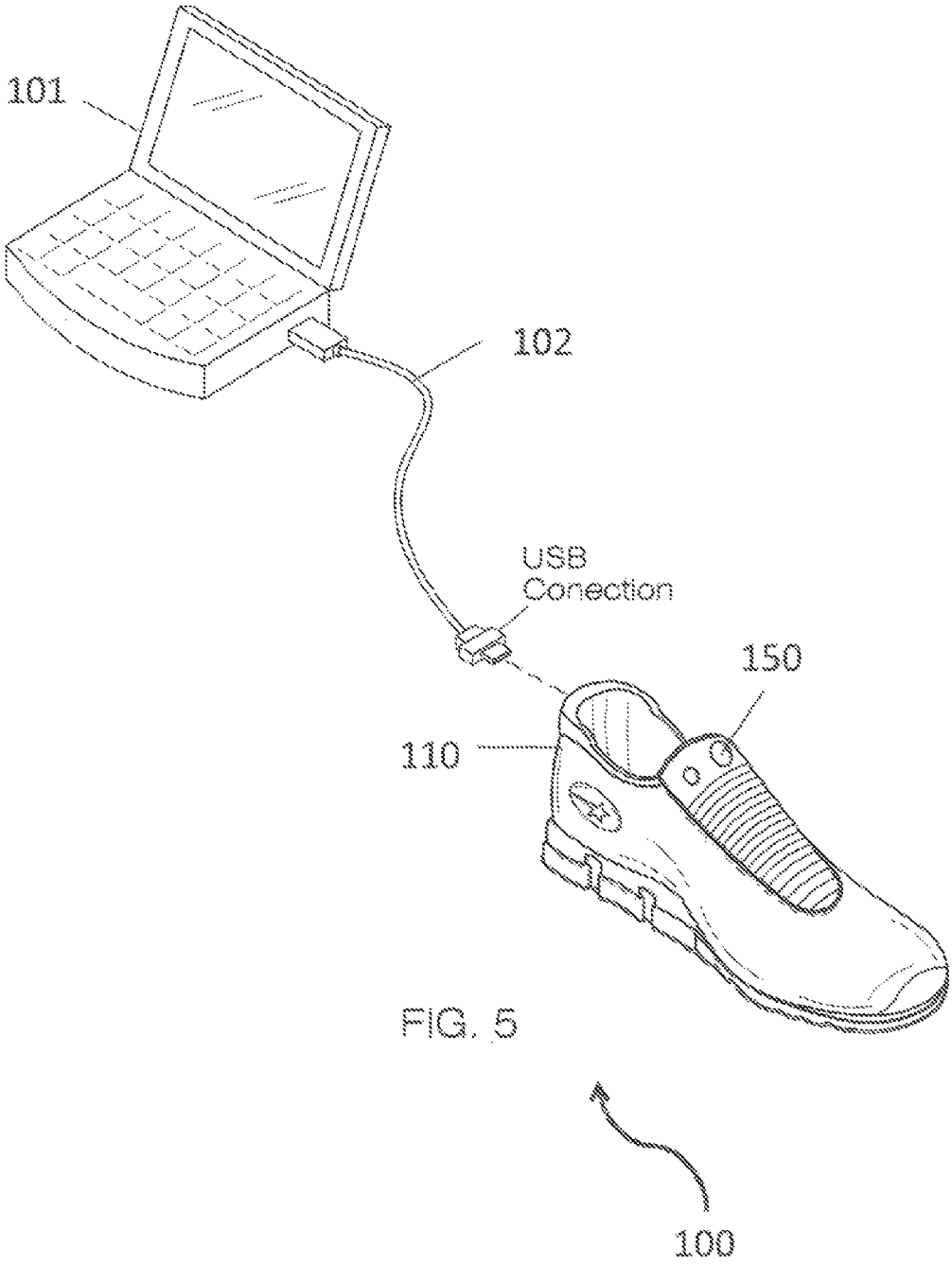
FIG. 5 is a perspective view of the shoe device of FIG. 1 as connected to a computer (e.g., to the Internet) via a USB cable.
Figure 6:
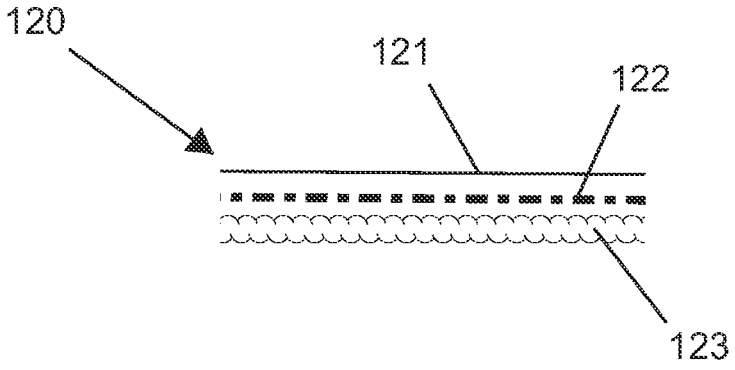
FIG. 6 is a side view of the three layers of the display.

Referring now to FIG. 1-6, the present invention features a shoe device 100 with electronic graphic displays. The electronic graphic designs can enhance the appearance of the shoe device 100. The shoe device 100 has various displays, for example liquid crystal displays that display graphic patterns, colors, and designs. Examples of graphic displays and patterns include but are not limited to: the appearance of water moving, quick moving streaks of light, sunsets and sunrises, and the like. The shoe allows a user to download different colors and designs from a media, for example the Internet or a hard drive (memory storage media). A user can change his or her shoe style (e.g., appearance) when desired, and in some cases he/she can change styles (e.g., appearance) by pushing one or more buttons on the shoes. In some embodiments, logos and themes can be chosen, for example sports logos, holiday themes, etc. Or, logos from music artists may be available. The shoe device 100 of the present invention is not limited to these options.

The shoe device 100 comprises a shoe component 110 that resembles a standard shoe, which is well known to one of ordinary skill in the art. For example, the shoe component 110 has a sole, a heel area, a top portion, a tip, a tongue, a foot hole, etc. In some embodiments, a protective pad 128 is disposed on the tip of the shoe component 110 for helping to protect the shoe component 110 from damage. In some embodiments, one or more air holes 129 are disposed in the sole of the shoe component 110.

As shown in FIG. 1, an electronic display 120 is disposed on the top portion of the shoe component 110, the first side of the shoe component 110, the second side of the shoe component 110, and/or the back (heel area) of the shoe component 110). The display 120 may also be disposed on the tongue of the shoe component 110, and/or the like.

The display 120 provides active color and graphic control for either the entire top portion of the shoe component 110 or a portion thereof. The display 120 may be constructed from flexible organic light-emitting diodes (OLED) displays, e-ink technology, digital fabrics, or other known means of active electronic color and graphic display means. Such electronic graphic display means are well known to one of ordinary skill in the art. For example, an organic light emitting diode (OLED) (e.g., a light emitting polymer (LEP), and organic electro luminescence (OEL)) is a light-emitting diode (LED) whose emissive electroluminescent layer is composed of a film of organic compounds. The layer usually contains a polymer substance that allows suitable organic compounds to be deposited in rows and columns onto a flat carrier by a simple "printing" process. The resulting matrix of pixels can emit light of different colors. Such systems can be used in television screens, computer monitors, small, portable system screens such as cell phones and PDAs, watches, advertising, information and indication. OLEDs can also be used in light sources for general space illumination, and large-area light-emitting elements. OLEDs typically emit less light per area than inorganic solid-state based LEDs, which are usually designed for use as point-light sources.

The display 120 of the shoe component 110 may be constructed from three layers: an outer layer 121, a middle layer 122, and an inner layer 123. The outer layer 121 is clear and durable. In some embodiments, the outer layer 121 is waterproof. The outer layer 121 is also flexible but can protect the center layer. The center (or middle) layer 122 comprises the digital displays and electronic systems. The inner layer 123 comprises fabric or other materials suitable for padding and comfort. The inner layer 123 also has a moisture barrier to protect the electronic components. Venting components may also be incorporated.

In some embodiments, the top portion of the shoe component 110 (e.g., the display 120) is segmented into portions (e.g., tongue, vamp). The portions may be controlled differently from each other. For example, the tongue area may have a static image while the other regions have dynamic images. Or, one portion may have static surface color and a second portion may have dynamic pattern display capability. The entire shoe component 110 may be designed to have color graphics capability in static or dynamic operation. In some embodiments, a logo component 165 is disposed on the shoe component 110 (e.g., see FIG. 1). Like the other display 120 areas of the shoe component 110, the logo component 165 may be programmable.

The display 120 is operatively connected to a microprocessor disposed in the shoe component 110 (e.g., wires 168). The microprocessor is further operatively connected to a data port, for example a universal serial bus (USB) port 160 (e.g., via wires 168). The data port allows transfer and retrieval of data to and from the microprocessor. Data ports and data transfer protocols are well known to one of ordinary skill in the art. As shown in FIG. 2, the data port (USB port) is disposed in the heel area of the shoe component 110.

Data can be obtained from a variety of sources. In some embodiments, an Internet website is dedicated to support of the shoe device 100 of the present invention. For example, the website may contain downloadable data and protocols (e.g., colors, color patterns, images, video content, logos, etc.) that can be uploaded into the microprocessor of the shoe device 100 (via the data port, via a cable 102, via a computer 101). As an example, the website may have a gallery for choosing colors to be displayed, as well as patterns of the colors (e.g., the timing of the color display can be manipulated by the second, minute, hour, etc.). In some embodiments, the display 120 can be programmed to fade the colors as it switches from one color to the next.

In some embodiments, data can be uploaded from other sources, for example DVDs, CDs, memory devices (e.g., flash memory), and the like. Sources may also include cellular phones, smart phones, personal digital assistants (PDAs), digital vending kiosks, and the like. In some embodiments, the data can be uploaded and downloaded via other mechanisms, for example wired or wireless mechanisms. Such mechanisms may include Bluetooth™, infrared datalink (IrDa), Wi-Fi, UWB, and the like.

In some embodiments, one or more control buttons 150 are disposed on the shoe component 110. The control buttons 150 allow a user to manipulate the display 120 as desired. The control buttons 150 are operatively connected to the microprocessor. The microprocessor is configured to receive input signals from the control buttons 150 and further send output commands to the display 120 to manipulate the display 120 according to the buttons pushed. The control buttons may be operatively connected to the display 120 and/or the microprocessor via one or more wires 109.

The microprocessor and/or display 120 are operatively connected to a power source, for example a battery. The battery may be rechargeable. In some embodiments, the battery comprises a control means for turning on and off the device. In some embodiments, the control means is configured to detect movement and turns the shoe device 100 on when it detects movement. When the control means does not detect movement, the control means may turn off the shoe device 100.

All wires and data ports and other electronic systems are adapted to sustain the weight of a client wearing the shoes.

The following the disclosures of the following U.S. Patents are incorporated in their entirety by reference herein: U.S. Pat. No. 5,577,828; U.S. Pat. No. 5,912,653; U.S. Pat. No. 6,393,745; U.S. Pat. No. 4,709,307; U.S. Pat. No. 5,722,192; U.S. Pat. No. 5,813,148.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A shoe device comprising:

(a) a shoe component having a protective pad disposed at a tip of the shoe component;

(b) an electronic display disposed on a top portion of the shoe component, a first side of the shoe component, a second side of the shoe component, a back of the shoe component, and a tongue of the shoe component, wherein the electronic display is constructed from at least three layers including a center layer constructed from a flexible organic light-emitting diode (OLED) display for providing active color and graphics, a waterproof outer layer, and a fabric inner layer, the outer layer and inner layer sandwich the center layer, wherein the flexible OLED display is divided into independently operating electronic display zones, wherein the fabric inner layer is effective to provide padding and comfort;

(c) a universal serial bus (USB) port disposed in a heel area of the shoe component;

(d) a microprocessor disposed in the shoe component operatively connected to both the flexible OLED display and the USB port, the microprocessor comprises a memory component for storing graphic data, the microprocessor is configured to send output commands to the flexible OLED display to cause the flexible OLED display to display the graphic data, wherein the USB port functions to transfer alternate graphic data from a source to the memory component of the microprocessor;

(e) one or more control buttons disposed on the tongue of the shoe component and operatively connected to the microprocessor, the microprocessor is configured to receive input signals from the control buttons and subsequently send output commands to the flexible OLED display to manipulate the flexible OLED display; and (f) a power source operatively connected to microprocessor and the flexible OLED display;

wherein the independently operating electronic display zones are controlled either independently or in conjunction with each other, wherein the flexible OLED display is adapted to display static graphic data, dynamic graphic data, or a combination thereof.

2. The shoe device of claim 1, wherein the inner layer comprises a moisture barrier to protect the flexible OLED display.

3. The shoe device of claim 1 further comprising a logo component disposed on the shoe component, wherein the logo component is an independent flexible OLED display.

4. The shoe device of claim 1, wherein the power source is a battery.

5. A shoe device consisting of:

(a) a shoe component having a protective pad disposed at a tip of the shoe component;

(b) an electronic display disposed on a top portion of the shoe component, a first side of the shoe component, a second side of the shoe component, a back of the shoe component, and a tongue of the shoe component, wherein the electronic display is constructed from at least three layers including a center layer constructed from a flexible organic light-emitting diode (OLED) display for providing active color and graphics, a waterproof outer layer, and a fabric inner layer, the outer layer and inner layer sandwich the center layer, wherein the flexible OLED display is divided into independently operating electronic display zones, wherein the fabric inner layer is effective to provide padding and comfort;

(c) a universal serial bus (USB) port disposed in a heel area of the shoe component;

(d) a microprocessor disposed in the shoe component operatively connected to both the flexible OLED display and the USB port, the microprocessor comprises a memory component for storing graphic data, the microprocessor is configured to send output commands to the flexible OLED display to cause the flexible OLED display to display the graphic data, wherein the USB port functions to transfer alternate graphic data from a source to the memory component of the microprocessor;

(e) one or more control buttons disposed on the tongue of the shoe component and operatively connected to the microprocessor, the microprocessor is configured to receive input signals from the control buttons and subsequently send output commands to the flexible OLED display to manipulate the flexible OLED display; and (f) a power source operatively connected to microprocessor and the flexible OLED display;

wherein the independently operating electronic display zones are controlled either independently or in conjunction with each other, wherein the flexible OLED display is adapted to display static graphic data, dynamic graphic data, or a combination thereof.

* * * * *